United States Patent [19]

Niedecker

[11] 4,182,015

[45] Jan. 8, 1980

[54] WIRE CLOSURE CLIP

[76] Inventor: Herbert Niedecker, Am Ellerhang 6, Königstein, Fed. Rep. of Germany, 6240

[21] Appl. No.: 882,823

[22] Filed: Mar. 2, 1978

[30] Foreign Application Priority Data

Mar. 9, 1977 [DE] Fed. Rep. of Germany ..... 2710210

[51] Int. Cl.[2] ..... B23P 11/00

[52] U.S. Cl. ..... 29/243.56

[58] Field of Search ..... 29/243.56, 243.5; 24/30.5 W, 27, 115 A; 140/53, 57, 93 D; 53/138 A

[56] References Cited

U.S. PATENT DOCUMENTS

| | | | |
|---|---|---|---|
| 2,700,805 | 2/1955 | Bedford | 24/30.5 W |
| 3,120,230 | 2/1964 | Skold | 24/27 |
| 3,138,838 | 6/1964 | Richardson | 24/30.5 W |
| 3,506,116 | 4/1970 | Winters | 24/27 |
| 3,908,234 | 9/1975 | Niedecker | 24/30.5 W |
| 4,044,450 | 8/1977 | Raudys et al. | 29/243.57 |

FOREIGN PATENT DOCUMENTS

| | | | |
|---|---|---|---|
| 1199686 | 8/1965 | Fed. Rep. of Germany | 24/30.5 W |

*Primary Examiner*—James L. Jones, Jr.

*Attorney, Agent, or Firm*—Sprung, Felfe, Horn, Lynch & Kramer

[57] ABSTRACT

In a clip for closing a tubular wrapper, bag or the like, comprising a curved, U-shaped length of wire, which is adapted to be driven along a clip guideway by a punch against a die and thus closed around the gathered wrapper, the improvement which comprises forming each leg of the clip with an outwardly direct portion. A plurality of such clips are arranged one behind the other in a bar or stack. The bar is used in combination with the clip closing device including a clip guideway and comprising means for advancing said bar toward said guideway, a die for a clip in said guideway, and retractable punch for advancing a clip in said guideway toward said die, said punch having a pair of side portions with respective outwardly directed arcuate portions for receiving the outwardly directed portions of said legs of the clip, whereby upon retraction of said punch if the clip is not closed it will be retracted with said punch so as not to permit the next clip of said bar to be advanced toward said guideway.

2 Claims, 8 Drawing Figures

WIRE CLOSURE CLIP

This invention relates to a clip for closing tubular wrappers, bags or the like, comprising a curved, U-shaped length of wire, which is driven along a clip guideway by a punch against a die and is thus closed around the gathered wrapper.

Such closing clips in various forms have been disclosed for hand- or power-operable closing devices. A plurality of such clips are usually supplied in the form of a bar, which is vertically advanced into the clip guideway by spring pressure or under the action of its own weight or of an additional weight, when the punch has been retracted. The punch is then operated to separate individual clips from the clip bar and to force each clip against the die. The space for receiving each clip in the clip guideway is closed by the punch when it is advanced and said space is exposed only when the punch has been fully retracted.

It has now been found that the clip-closing operation is sometimes not completed, particularly in hand-operated closing devices. In that case, the punch is retracted to its closing position although the clip disposed in the clip guide has not been driven against the die and closed and removed from the device together with the closed wrapper. By the next operation of the closing device, another clip is separated from the clip bar and advanced in the clip guideway. The first clip which is still in the clip guideway then prevents the closing of the wrapper and necessarily causes the wrapper to be damaged or gives rise to trouble in the operation of the closing device.

For this reason it is an object of the invention to ensure that a clip cannot be introduced into the clip guideway so long as the guideway still contains a clip which entered the clip guideway in a preceding closing operation that has not been completed.

This object is accomplished according to the invention in that the legs of the curved, U-shaped length of wire have outwardly directed portions, which are received and engaged in recesses of the punch.

In this way it is ensured that clips are taken along by the punch not only as it is advanced but also as it is retracted when the closing operation has not been completed so that in the latter case the retracted clip occupies the space which is required for receiving a clip in the clip guideway so that a second clip from the clip bar cannot be forced into the clip guideway. The outwardly directed portions of the clip legs are not removed from the recesses in the punch until the clip is closed around the wrapper on the die so that the clip is not removed from the punch until the closing operation has been completed. Besides, incomplete closing operations in any desired number can be performed without trouble in the operation of the device because in accordance with the invention the clip is reliably taken along by the punch not only as it is advanced but also as it is retracted.

This eliminates a source of inconvenient trouble in manually operated closing devices. Besides, the clip according to the invention may be used to advantage also in power-operated closing devices. Whereas incomplete closing operations are rare in such power-operated devices, the outwardly directed portions of the clip legs improve the guidance of the clip also in such d power-operated devices because a canting of the clip is more reliably avoided. It has also been found that the clip according to the invention can embrace the gathered wrapper in an improved manner so that an improved closure is ensured.

According to an additional feature of the invention the ends of the clip legs initially have an inward curvature. Besides, the legs of the curved, U-shaped length of wire may be curved in the same sense to match a circular clip guideway.

The device employed to close the clips according to the invention suitably comprises a punch which has not only recesses for receiving the outwardly directed clip portions but also has undercut portions which are complementary to the side edges of the dies. Such punch can be advanced to overlap the die to a very large extent, as is required when it is desired to close thin-walled wrappers having a gathered portion which is small in cross-section.

Further details and advantages will be explained more fully with reference to preferred embodiments shown by way of example in the drawings, wherein.

Figure 1:
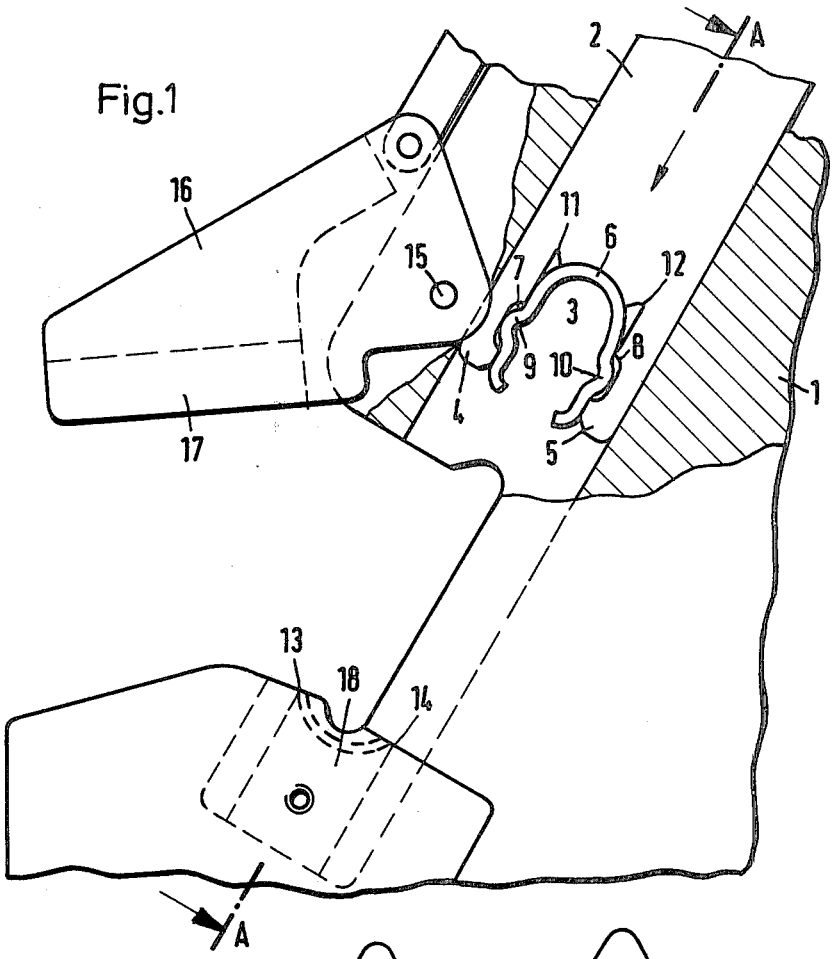
FIG. 1 is a side elevation showing a closing device, partly in section, and a clip.

FIG. 1 shows a closing device 1 having a slidable punch 2, which has two side portions 4, 5 that define a space 3 for receiving a clip 6. In accordance with the invention, the legs of the clip 6 have outwardly directed, arcuate portions 9, 10, which are received and engaged in recesses 7, 8 in the side portions 4, 5 of the punch 2. The punch 2 also has undercut portions 11 12, which are complementary to side edges 13, 14 of a die 18. One portion 17 of the clip guideway is formed in a cover 16, which is hinged on a pin 15 and pivotally movable to the illustrated position to permit insertion of a wrapper into the closing device 1.

Figure 2:
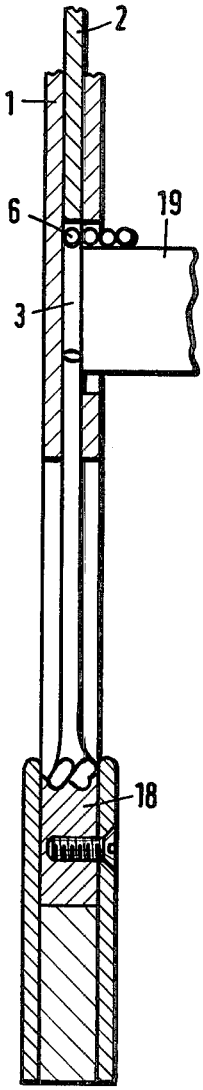
FIG. 2 is a sectional view taken on line A—A in FIG. 1.

It is apparent from FIG. 2 how the clips 6 on the clip guide 19 enter the receiving space 3 of the punch 2 when the latter has been fully retracted in the closing device. The die 18 is shown in cross-section in the lower portion of FIG. 2.

Figure 4:
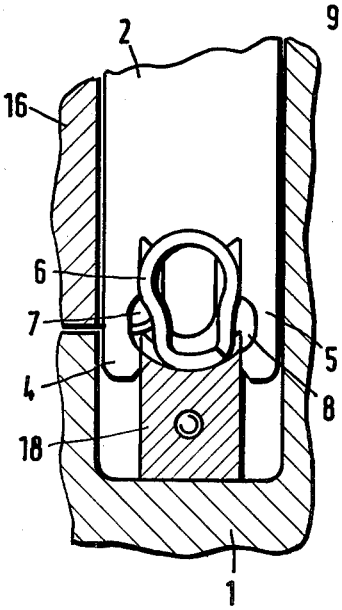
FIGS. 3 and 4 show a portion of FIG. 1 with the punch in different positions during the closing operation.
Figure 3:
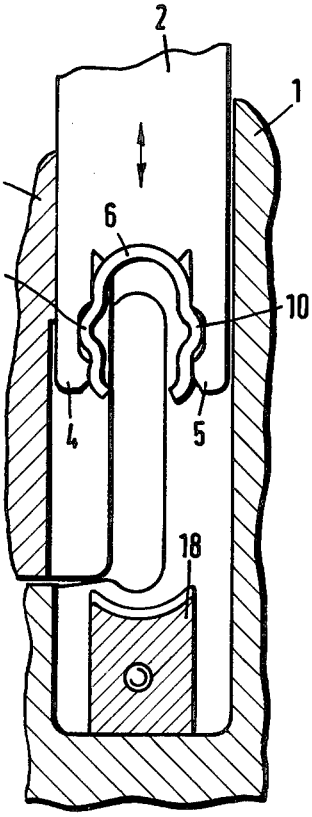

In the position shown in FIG. 3, the cover 16 is closed and the punch 2 together with the clip 6 has been advanced to some extent towards the die 18. As the punch is advanced further and the clip 6 is shaped and closed on the die 18, the side portions 4, 5 of the punch 2 enter the free spaces beside the die 18 (FIG. 4). In this operation, the outwardly directed portions 9 of the clip legs are removed from the recesses 7, 8 of the punch 2 so that the closed clip will not be taken along by the punch 2 as it is retracted.

Figure 5:
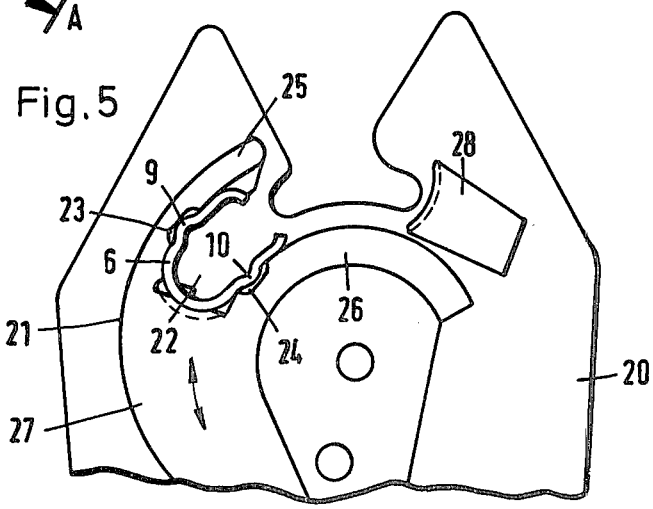
FIG. 5 is a fragmentary view showing a portion of a closing device having a circular clip guideway together with a clip.

FIG. 5 shows a closing device 20 which has a clip guideway 21 having the configuration of an arc of a circle. A punch 27 has a receiving space 22 for receiving a clip 6 which has legs that are curved in the same sense. The punch 27 also has side portions 25, 26, which are formed with recesses 23, 24, in which the outwardly directed portions 9 of the clip 6 are received and engaged. The punch 27 either closes the clip 6 on the die 28, or when the clip is not closed, takes the clip along as the punch is retracted.

Figure 6:
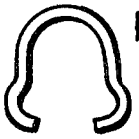
FIGS. 6 to 8 show clips having different configurations.
Figure 7:
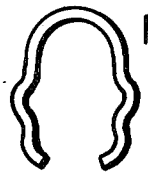
Figure 8:
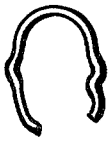

FIGS. 6 to 8 show different embodiments of clips according to the invention.

In FIGS. 6 and 7 the outwardly directed portions are disposed at the free end of each leg or midway of the length of the leg. This depends on the thickness of the gathered portion of the wrapper.

FIG. 8 shows a clip having legs which are curved in the same sense. This clip is intended for use in closing devices having a clip guideway which has the configuration of an arc of a circle.

It will be appreciated that the instant specification and examples are set forth by way of illustration and not limitation, and that various modifications and changes may be made without departing from the spirit and scope of the present invention.

What is claimed is:

1. In combination, a bar of clips each adapted to close a tubular wrapper, bag or the like, and a closing device for each clip, each clip consisting essentially of a curved U-shaped length of metal wire, the legs of the clip being curved inwardly toward one another at the ends thereof and each including an outwardly directed portion on each leg, the closing device including a clip guideway and comprising means for advancing said bar toward said guideway, a die for a clip in said guideway, and a retractable punch for advancing a clip in said guideway toward said die and thereby to close around the gathered wrapper, said punch having a pair of side portions with respective outwardly directed arcuate portions for receiving the outwardly directed portions of said legs of the clip, whereby upon retraction of said punch if the clip is not closed it will be retracted with said punch so as not to permit the next clip of said bar to be advanced toward said guideway.

2. A combination according to claim 1, wherein the legs of the clip are curved in the same sense so as to be movable along a clip guideway having the configuration of an arc of a circle.

* * * * *